US008590722B2

(12) United States Patent
Kim

(10) Patent No.: US 8,590,722 B2
(45) Date of Patent: Nov. 26, 2013

(54) VACUUM RECEPTACLE LID FOR EASY SEALING

(75) Inventor: Chun Yong Kim, Busan (KR)

(73) Assignee: Kodaecs Co., Ltd., Busan (KR)

( * ) Notice: Subject to any disclaimer, the term of this patent is extended or adjusted under 35 U.S.C. 154(b) by 0 days.

(21) Appl. No.: 13/516,724

(22) PCT Filed: Sep. 15, 2010

(86) PCT No.: PCT/KR2010/006291

§ 371 (c)(1),
(2), (4) Date: Jun. 15, 2012

(87) PCT Pub. No.: WO2011/090249

PCT Pub. Date: Jul. 28, 2011

(65) Prior Publication Data

US 2012/0273488 A1 Nov. 1, 2012

(30) Foreign Application Priority Data

Jan. 21, 2010 (KR) ..... 20-2010-0000665

(51) Int. Cl.

| | |
|---|---|
| ***B65D 51/16*** | (2006.01) |
| ***F16J 15/18*** | (2006.01) |
| ***F16J 15/26*** | (2006.01) |

(52) U.S. Cl.

USPC ..... 220/203.29; 277/530

(58) Field of Classification Search

USPC ..... 277/530, 534, 644, 647, 649, 650, 637, 277/913, 928; 215/260, 307; 220/203.29, 220/367.1, 378, 366.1, 231, 658

See application file for complete search history.

(56) References Cited

U.S. PATENT DOCUMENTS

| | | | | |
|---|---|---|---|---|
| 3,441,166 | A * | 4/1969 | Frees | 220/324 |
| 4,666,190 | A * | 5/1987 | Yamabe et al. | 285/93 |
| 5,641,085 | A | 6/1997 | Lonbardo | |
| 6,644,489 | B2 * | 11/2003 | Chang | 220/203.01 |

FOREIGN PATENT DOCUMENTS

| | | |
|---|---|---|
| DE | 4109540 A1 * | 10/1991 |
| JP | 56-113659 | 1/1980 |
| JP | 63-82761 | 5/1988 |
| JP | 3-78780 | 8/1991 |

(Continued)

OTHER PUBLICATIONS

International Search Report of International Application No. PCT/KR2010/006291, dated May 4, 2011.

(Continued)

*Primary Examiner* — J. Gregory Pickett
*Assistant Examiner* — Jennifer N Zettl
(74) *Attorney, Agent, or Firm* — Kile Park Reed & Houtteman PLLC

(57) ABSTRACT

A vacuum receptacle lid for easy sealing includes a lid body that closes and opens an inlet portion of a receptacle body provided with a space containing contents, a valve installation hole formed at a part thereof, at least one air vent hole, and a packing installation groove which is opened downwardly in a C shape inside a rim thereof. A check valve providing a combining projection at a bottom surface of a body portion enclosing the air vent hole is inserted into and combined with the valve installation hole and exhausts air of the inside of the receptacle body via the air vent hole blocking inflow of external air by enclosing, opening and closing the air vent hole. A packing is accommodated and installed at the packing installation groove and includes upper, lower, and intermediate contact portions which have a cross-section of a zigzag shape.

8 Claims, 12 Drawing Sheets

(56) References Cited

FOREIGN PATENT DOCUMENTS

| | | | |
|---|---|---|---|
| JP | 5-287093 | | 11/1993 |
| JP | 05-287093 | A | 11/1993 |
| JP | 8-217127 | | 8/1996 |
| JP | 9-30555 | | 2/1997 |
| JP | 2008-162631 | | 7/2008 |
| JP | 2010-500246 | | 1/2010 |
| KR | 20-1986-0004807 | U | 5/1986 |
| KR | 20-1993-0002630 | U | 2/1993 |
| KR | 20-0391434 | Y1 | 8/2005 |
| KR | 10-2008-0014536 | A | 2/2008 |
| KR | 10-2008-0056452 | A | 6/2008 |

OTHER PUBLICATIONS

PCT Written Opinion by International Search Authority for International Application No. PCT/KR2010/006291, dated May 4, 2011.

* cited by examiner

VACUUM RECEPTACLE LID FOR EASY SEALING

TECHNICAL FIELD

The present invention relates to a vacuum receptacle lid for easy sealing, and more particularly to a vacuum receptacle lid capable of exhausting air of the inside of the receptacle through a check valve by pushing the lid provided with a packing combined with a receptacle body so as to vacuum-seal the receptacle inside, thereby preventing contents such as foods stored in the inside from decaying and keeping the contents fresh.

BACKGROUND ART

Along with a technique for keeping foods refrigerated in order to prevent spoiling of contents such as foods and store them for a long time, there has been developed and used a vacuum receptacle of which the inside containing foods is made vacuum so as to store the foods for a long time.

As the representative related art regarding such a vacuum receptacle, there is a "multi-purpose vacuum receptacle lid" which has a check valve for exhausting air, as shown in FIGS. 8 to 12, disclosed in Korean Unexamined Patent Application Publication No. 2008-0014536 which has been filed by the Applicant 'Pak, Yun-Sik'.

In the vacuum receptacle lid in the related art, as shown in FIG. 10, when a user covers an inlet portion 12 with a lid body and pushes the lid body 20 down in a state of putting the contents such as foods in a receptacle body 10, a contact portion 44 of a packing 40 comes into contact with the inlet portion 12 of the receptacle body 10, the outer end portion thereof is bent upwardly such that the lid body moves down, and thus air inside the receptacle body 10 pushes up a check valve 30 and is exhausted out of the receptacle 1 through an air vent hole 24. When the user stops pushing the lid body, the lid body which has moved down slightly rises due to the elastic recovery of the packing 40, which inflates the air inside the receptacle and thus vacuumizes the receptacle. At this time, as shown in FIG. 11, the packing 40 is bent in a form fitted to the inside of the inlet portion 12 of the receptacle body 10 so as to come into contact therewith, thereby closing the inlet of the receptacle body 10. However, the vacuum receptacle lid in the related art has a configuration where the thickness of the contact portion 44 of the packing 40 decreases at the outer end portion. Therefore, there is a problem in that, since the outer end portion of the contact portion 44 coming into contact with the inside of the inlet portion 12 is very thin, even if the user strongly pushes down the lid body 20, the elastic recovery of the packing 40 is weak, and thus the inside of the receptacle is not greatly vacuumized, thereby reducing a sealing force.

In addition, there is a problem in that a separate vacuumization device for high vacuum is used due to such a configuration of the packing 40.

In addition, since the contact portion 44 of the packing 40 closes the inlet of the receptacle body 10 in a state of being bent and coming into contact therewith such that the outer end portion is fitted to the inside of the inlet portion 12, the contact part of the contact portion 44 is thin and the sealing is unstably performed. Therefore, there is a problem in that external air gradually inflows into the inside of the receptacle through the outer end portion of the contact portion 44 with the passage of time, and thereby a vacuum force is reduced in the inside of the receptacle.

Further, since the air vent hole 24 is provided so as to be adjacent to a valve mounting groove 132 and thus does not come into complete contact with the packing 40, there is a problem in that liquid such as juice of foods in the receptacle is leaked to the space with the packing 40 via the air vent hole 24 when the foods are stored and the receptacle is used, and thereby the vacuum receptacle or the foods are inclined to be contaminated and the vacuum force of the receptacle inside is reduced.

SUMMARY OF INVENTION

Technical Problem

Therefore, an object of the present invention is to provide a vacuum receptacle lid for easy sealing of a receptacle by easily achieving high vacuum of the inside of the receptacle without a user using a separate vacuumizing device or taking great pains.

In addition, another object of the present invention is to provide a vacuum receptacle lid capable of preventing the contents such as foods from spoiling or decaying and of keeping the contents fresh for a long time by maintaining an initial high vacuum state for a long time.

Moreover, still another object of the present invention is to prevent contamination of the receptacle and the foods by blocking liquid such as juice of the foods from being leaked to outside when the foods are stored and the receptacle is used.

Solution to Problem

A vacuum receptacle lid for easy sealing according to an embodiment of the present invention for solving the problems includes a lid body that closes and opens an inlet portion of a receptacle body provided with a space containing contents, and includes a valve installation hole formed at a part thereof, at least one air vent hole, and a packing installation groove which is opened downwardly in a C shape inside a rim thereof; a check valve that is provided a combining projection at a bottom surface of a body portion enclosing the air vent hole, is inserted into and combined with the valve installation hole, and exhausts air of the inside of the receptacle body via the air vent hole and blocks inflow of external air by enclosing, opening and closing the air vent hole; and a packing that is accommodated and installed at the packing installation groove, and includes an upper contact portion coming into contact with an upper surface of the packing installation groove, a lower contact portion coming into contact with the receptacle body, and an intermediate contact portion of which ends are connected to at least a part of the upper contact portion and the lower contact portion and which has a cross-section of a zigzag shape.

The lower contact portion and the intermediate contact portion may be provided so as to have the width smaller than that of the upper contact portion, and air inside the packing installation groove may be exhausted to outside via side surfaces of the intermediate contact portion and the lower contact portion when the inlet portion of the receptacle body comes into contact with the lower contact portion so as to vacuumize the inside of the receptacle.

At least upper contact projection may be formed at the upper surface of the upper contact portion in a longitudinal direction.

At least lower contact projection may be formed at the lower surface of the lower contact portion in a longitudinal direction.

The packing may undergo a surface corrosion process through a micro discharge process.

The packing may have a Shore A hardness of 50 to 70.

Preferably, the packing installation groove is further provided with a protrusion accommodating the upper contact portion so as to be combined therewith at a side surface.

Preferably, the packing has the entire height of 10 to 20 mm, the thickness of each of the upper contact portion and the lower contact portion is 1 to 3 mm, the thickness of the intermediate contact portion is 0.5 to 2 mm, and the maximum contraction ratio to the height is 40 to 70%.

The air vent hole is preferably formed at an edge of a valve mounting groove and is enclosed by and comes into contact with an edge of the body portion.

Advantageous Effect of Invention

As such, according to the vacuum receptacle lid for easy sealing of the present invention, there is an advantageous effect that the vacuum receptacle is easily sealed by achieving high vacuum of the inside of the receptacle without a user using a separate vacuumizing device or taking great pains with a packing structure having excellent elastic recovery.

In addition, according to the vacuum receptacle lid for easy sealing of the present invention, there is an advantageous effect that, since the packing coming into contact with the inlet portion of the receptacle body has a sufficient thickness in order to block inflow of external air and sealing is stably performed inside the packing installation groove, an initial high vacuum state can be maintained for a long time, and contents such as foods can be prevented from spoiling or decaying and the contents can be kept fresh for a long time by blocking liquid such as juice of the foods from being leaked to outside via the packing installation groove or the air vent holes when the foods are stored and the receptacle is used.

REFERENCE SIGNS LIST

Figure 1:
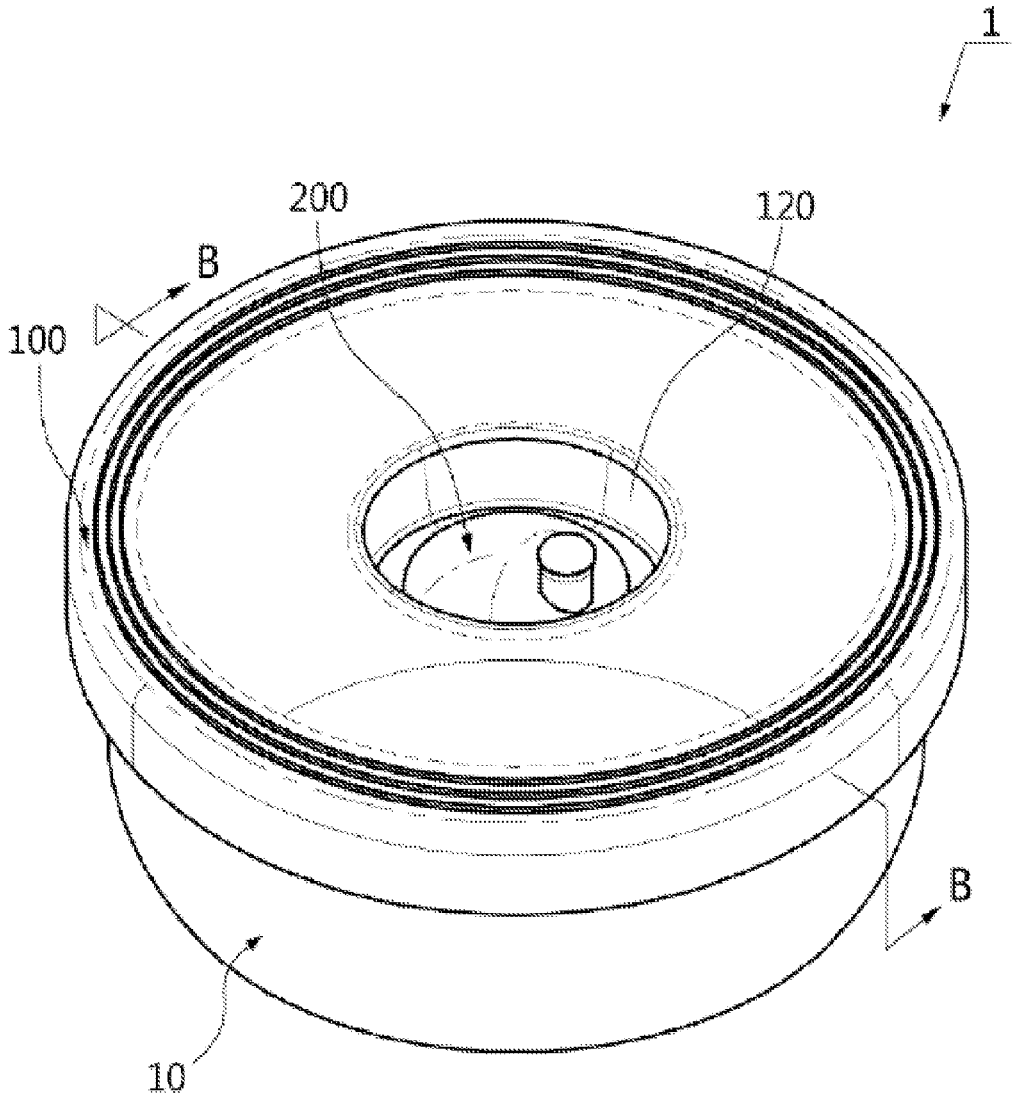
FIG. 1 and FIG. 2 are respectively an assembled perspective view and an exploded perspective view of a vacuum receptacle to which a vacuum receptacle lid for easy sealing according to an embodiment of the present invention is applied.

1: VACUUM RECEPTACLE
10: RECEPTACLE BODY
12: INLET PORTION
12*a*: CONTACT PORTION
100, 101: LID BODY
120: VALVE MOUNTING GROOVE
122: VALVE INSTALLATION HOLE
124: AIR VENT HOLE
130, 131: RIM
132: PACKING INSTALLATION GROOVE
134: UPPER SURFACE
136: SIDE SURFACE
138: PROTRUSION
200: CHECK VALVE
210: BODY PORTION
220: COMBINING PROJECTION
230: GRIP PORTION
300: PACKING
310: UPPER CONTACT PORTION
312: UPPER CONTACT PROJECTION
320: INTERMEDIATE CONTACT PORTION
330: LOWER CONTACT PORTION
332: LOWER CONTACT PROJECTION

DESCRIPTION OF EMBODIMENTS

The advantages and features of the present invention and the methods for achieving them will be apparent by referring to embodiments described later in detail along with the accompanying drawings. However, the present invention is not limited to the embodiments described below, and will be implemented by various different forms. In addition, the embodiments complement the disclosure of the present invention and are provided for a person skilled in the art to fully understand the scope of the present invention, and the present invention is defined only by the appended claims.

The same reference numeral indicates the same constituent element throughout the specification. The embodiments disclosed in the present specification will be described with reference to the ideal perspective views and cross-sectional views of the present invention.

Hereinafter, with reference to the accompanying drawings, a vacuum receptacle lid for easy sealing and an operation method thereof according to various embodiments of the present invention will be described.

Here, since the vacuum receptacle lid for easy sealing and the operation method thereof according to various embodiments of the present invention are obtained by improving the "vacuum receptacle lid" disclosed in Korean Unexamined Patent Application Publication No. 2008-0014536, description will be made mainly based on improved constituent parts of the vacuum receptacle lid and differences in the operation method according thereto in a scope necessary to be easily implemented by a person skilled in the art, and the same constituent part and operation method can be easily confirmed in Korean Unexamined Patent Application Publication No. 2008-0014536 and thus a description thereof will be omitted.

Figure 2:
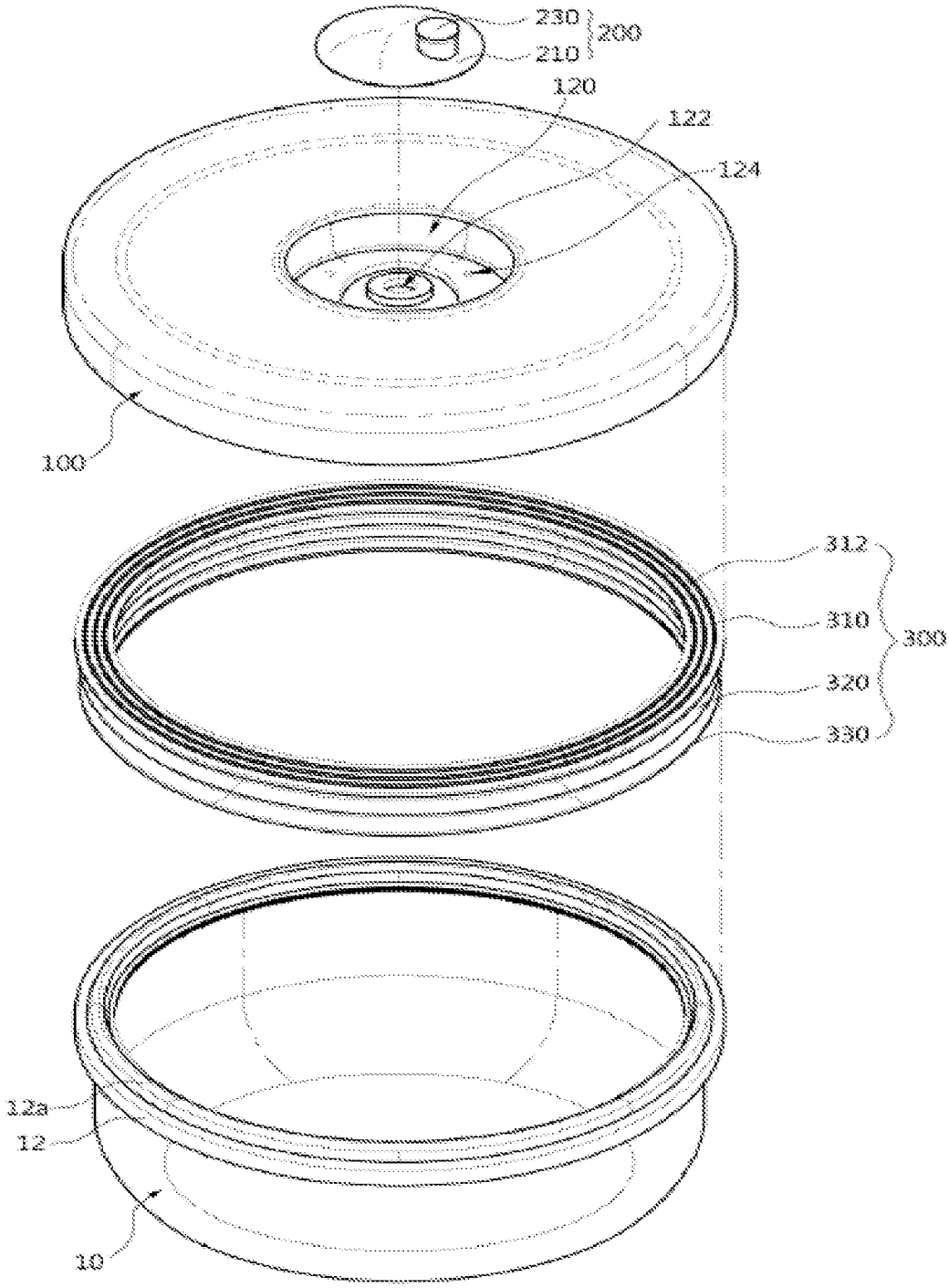
Figure 3:
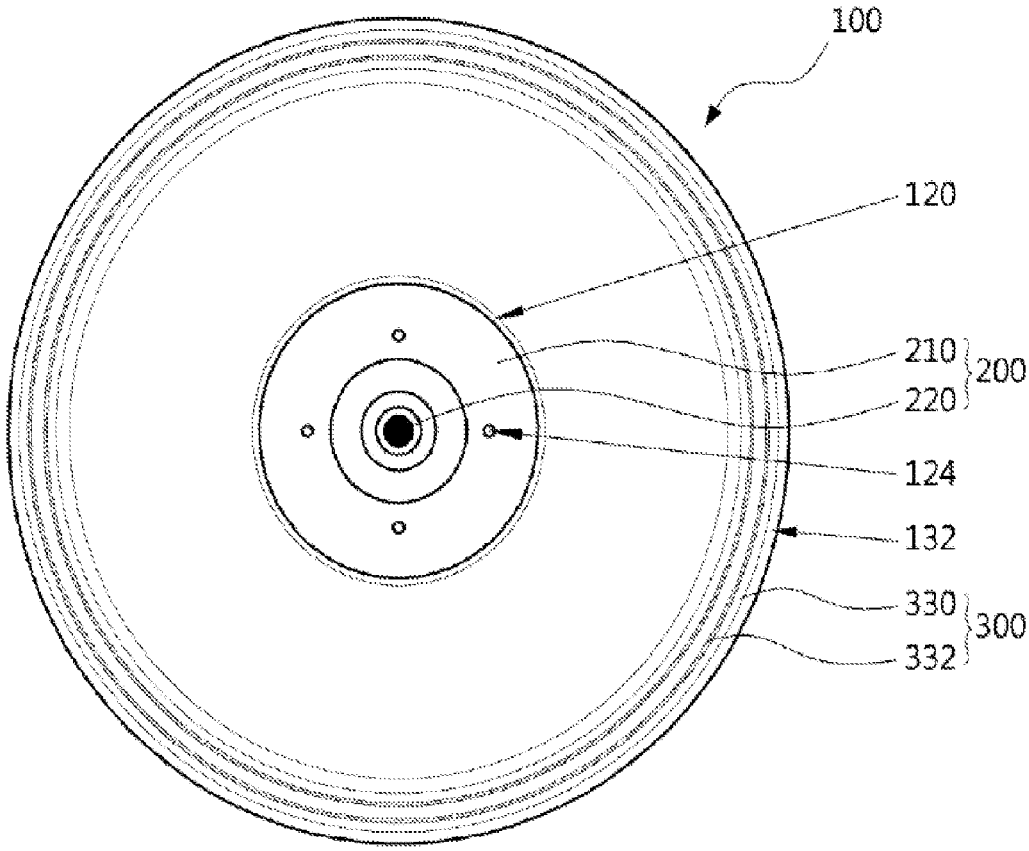
FIG. 3 is a bottom view of the vacuum receptacle lid for easy sealing according to the embodiment of the present invention.
Figure 4:
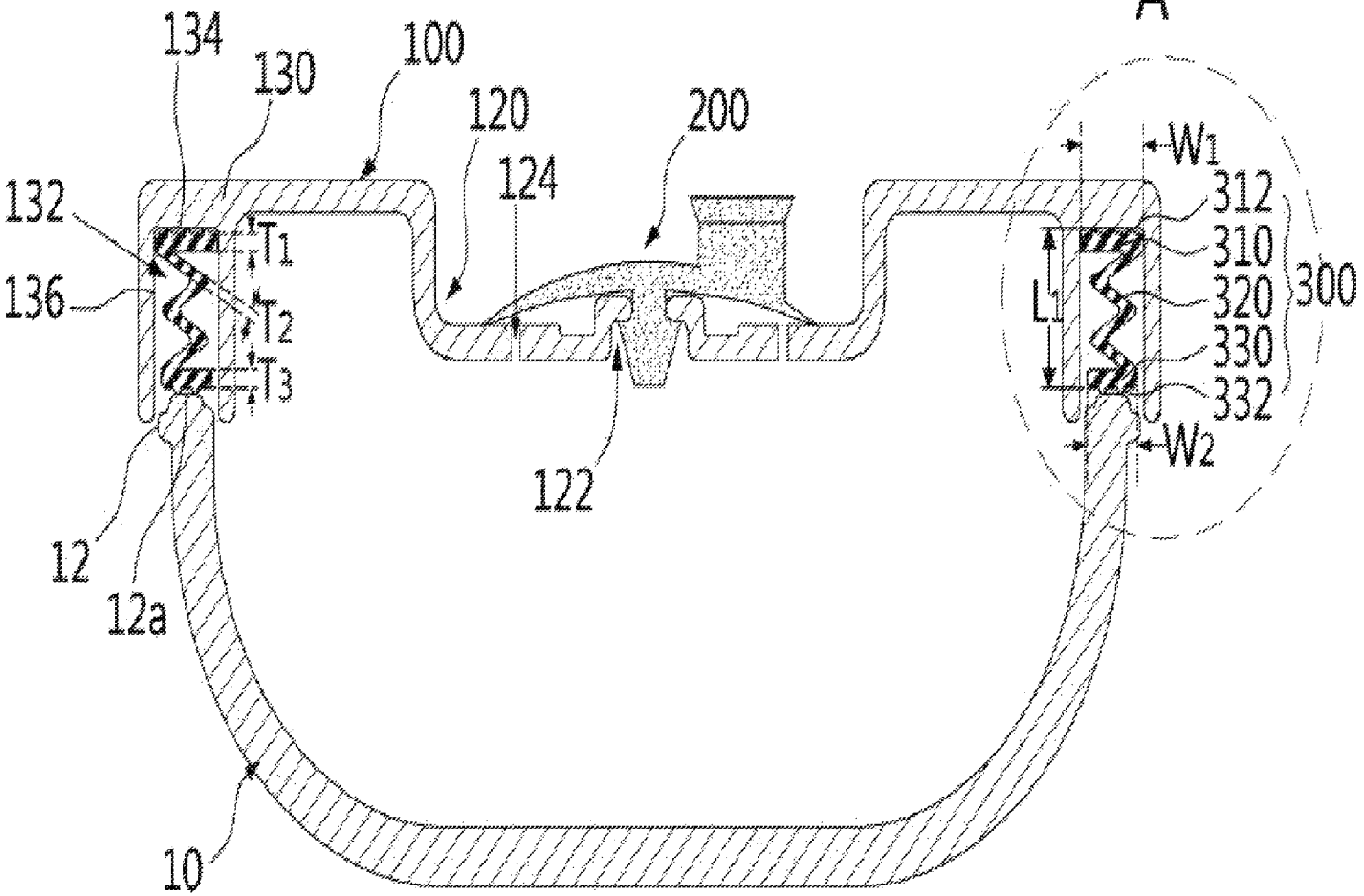
FIG. 4 and FIG. 5 are respectively cross-sectional views taken along the line B-B of FIG. 1, illustrating states before and after vacuum-sealing of the vacuum receptacle to which the vacuum receptacle lid according to the embodiment of the present invention is applied.
Figure 5:
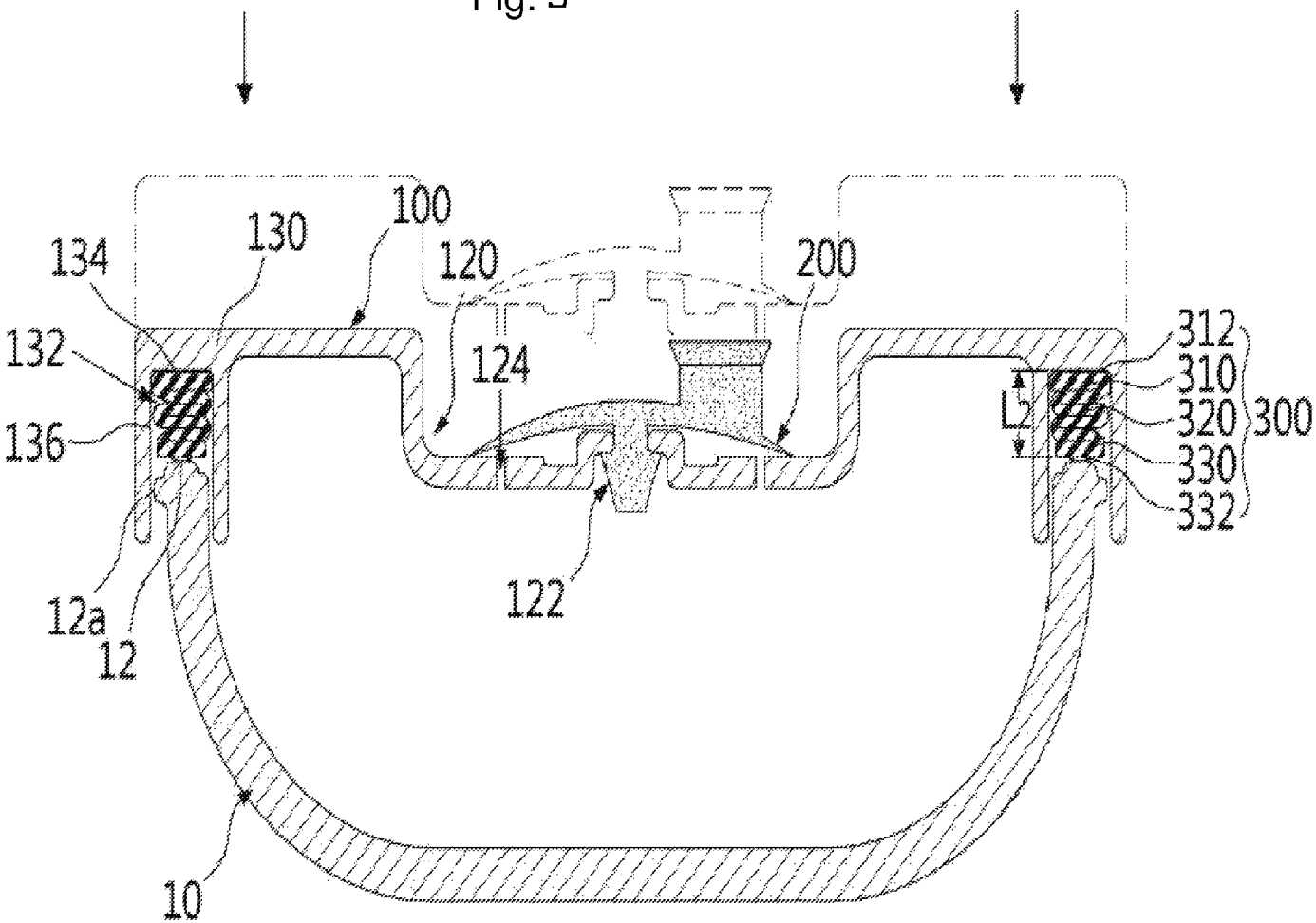
Figure 6:
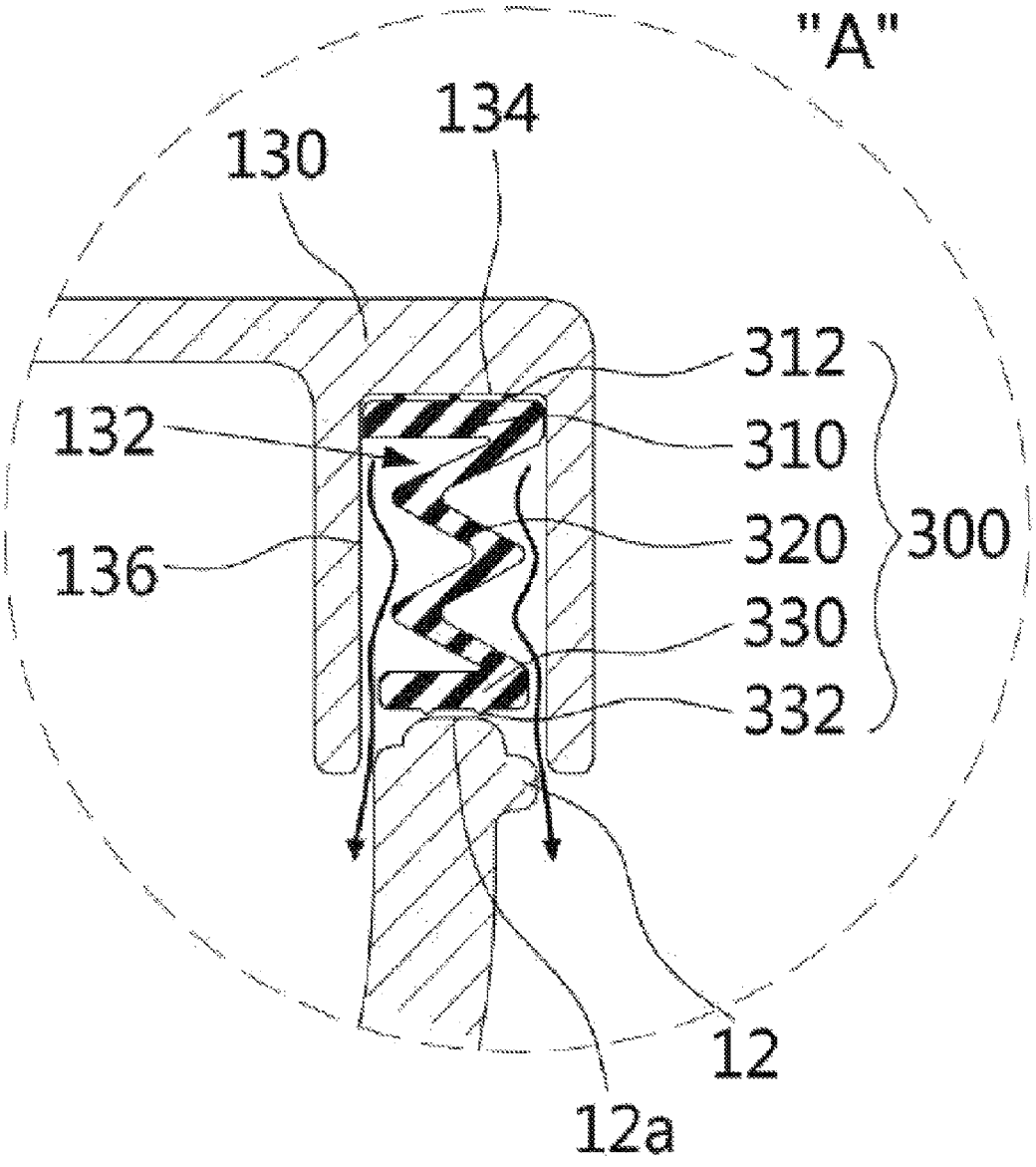
FIG. 6 is an enlarged view of the region "A" in FIG. 4, illustrating an operation during the vacuum-sealing of the vacuum receptacle to which the vacuum receptacle lid according to the embodiment of the present invention is applied.

First, a vacuum receptacle lid for easy sealing according to an embodiment of the present invention will be described in detail with reference to FIGS. 1 to 6. FIG. 1 and FIG. 2 are respectively an assembled perspective view and an exploded perspective view of a vacuum receptacle to which a vacuum receptacle lid for easy sealing according to an embodiment of the present invention is applied; FIG. 3 is a bottom view of the vacuum receptacle lid for easy sealing according to the embodiment of the present invention; FIG. 4 and FIG. 5 are respectively cross-sectional views taken along the line B-B of FIG. 1, illustrating states before and after vacuum-sealing of the vacuum receptacle to which the vacuum receptacle lid according to the embodiment of the present invention is applied; and FIG. 6 is an enlarged view of the region "A" in FIG. 4, illustrating an operation during the vacuum-sealing of the vacuum receptacle to which the vacuum receptacle lid according to the embodiment of the present invention is applied.

The present embodiment exemplifies a vacuum receptacle 1 of a substantially circular shape, and a shape of the vacuum receptacle may be triangle, rectangular, hexagonal, or octagonal, and the present invention is not limited by a shape thereof. However, there is a difference from the vacuum receptacle in the related art in that an inlet portion 12 of a receptacle body 10 provided with a space containing the contents such as foods is changed in the design so as to face upwardly from the bottom and to have a round type contact portion 12*a* for convenience of pressing. The contact portion 12*a* may be planar instead of the round type.

As shown in FIGS. 1 to 6, the vacuum lid for easy sealing according to an embodiment of the present invention includes a lid body 100, a check valve 200, and a packing 300.

The lid body 100 is installed at the inlet portion 12 which is an opening of the receptacle body 10 and opens and closes the inlet portion 12. For this, the lid body 100 is provided with a valve mounting groove 120 including a valve installation hole 122 provided at the center and a plurality of air vent holes 124 provided at the edge. A rim 130 of the lid body 100 is provided with a packing installation groove 132 which is curved downwardly and opened in a "C" shape so as to cover a specific part of the inlet portion 12 of the receptacle body 10 in cross-sectional view as shown in the cross-sectional view of FIG. 4. In other words, the packing installation groove 132 has a shape closed by the upper surface 134 and the side surface 136 except for the opening facing downwardly. The check valve 200 is inserted into and combined with the valve installation hole 122 by a combining projection 220 provided at the central bottom of a body portion 210 which completely encloses the air vent holes 124, and exhausts air of the inside of the receptacle body 10 via the air vent holes 124 and blocks inflow of external air by enclosing and opening and closing the air vent holes 124. In addition, when a grip portion 230 provided on one side of the upper part of the body portion 230 is pulled, air enters the inside via the air vent holes 124 and thus the vacuum state of the vacuum receptacle 1 is canceled.

The packing 300 is compressed by the lid body 100 which moves down when the lid is closed and is thus compressed in a state where a user pushes down the lid. When the user stops pushing down the lid, the packing 300 is restored and raises the lid which has moved down so as to inflate air in the receptacle, thereby vacuumizing the inside of the receptacle. The packing 300 has a circular strip form entirely coming into contact with and corresponding to the inlet portion 12 of the receptacle body 10, includes an upper contact portion 310, an intermediate contact portion 320, and a lower contact portion 330 entirely having the cross-section of a zigzag shape when viewed from the side surfaces, and is accommodated and installed in the packing installation groove 132. For this, the packing 300 undergoes a shape process by a method such as injection molding by the use of a natural rubber, a synthetic rubber or a silicon rubber material, is manufactured by corroding a surface thereof such that the surface thereof has fine roughness through a micro discharge process, and is thereby advantageous in that it is tightly installed in and comes into close contact with the packing installation groove 132 when accommodated and installed therein.

The upper contact portion 310 comes into contact with the upper surface 134 of the packing installation groove 132, and the upper surface 134 is provided with separate upper contact projects 312 in the longitudinal direction for increase in contact with the packing installation groove 132 when the contact is performed and for convenience of detachment from the packing installation groove 132 when the detachment is performed. The upper contact projection 312 is preferably 0.1 mm to 0.5 mm high, and this is because, if the height thereof is smaller than 0.1 mm, the detachment from the packing installation groove 132 is not easy when the detachment is performed, and, if the height thereof is larger than 0.5 mm, there is concern that the contact force is reduced when the packing comes into contact with the packing installation groove 132. On the other hand, the upper contact projections 312 may be omitted unlike in the present embodiment depending on a contact extent between the upper surface 134 and the upper contact portion 310. The lower contact portion 330 comes into contact with the contact portion 12*a* of the inlet portion 12 of the receptacle body 10 so as to vacuumize the inside of the vacuum receptacle 1 and is provided with separate lower contact projections 332 in the longitudinal direction for increase in the contact with the contact portion 12*a* when the contact is performed and for convenience of detachment from the contact portion 12*a* through the inflow of external air when the detachment is performed. In the same manner as the upper contact projection 312, the lower contact projection 332 is preferably 0.1 mm to 0.5 mm high, and this is because, if the height thereof is smaller than 0.1 mm, the detachment from the contact portion 12*a* is not easy when the detachment is performed, and, if the height thereof is larger than 0.5 mm, there is concern that the contact force with the contact portion 12*a* is reduced when the packing comes into contact with the packing installation groove 132.

On the other hand, the lower contact projections 332 may be omitted unlike in the present embodiment depending on a contact extent between the contact portion 12*a* and the lower contact portion 330.

The intermediate contact portion 320 has one end connected to the outside lower part of the upper contact portion 310 and the other end connected to the outside upper part of the lower contact portion 330, and an intermediate part thereof has a saw-tooth shape in a cross-section, that is, a zigzag shape. Although, in the present embodiment, the intermediate contact portion 320 has two saw-tooth shapes in a cross-section, it may have one or three or more saw-tooth shapes in a cross-section.

The width W2 of the intermediate contact portion 320 and the lower contact portion 330 are provided to be 0.5 times to 0.9 times the width W1 of the upper contact portion 310 in the transverse direction as shown in FIG. 4, and, in the present embodiment, 0.85 times is used as an optimal condition. This is because, if the width W2 of the intermediate contact portion 320 and the lower contact portion 330 is smaller than 0.5 times the width W1 of the upper contact portion 310, the contact area with the contact portion 12*a* is decreased and thus the contact force is lowered, and, conversely, if the width W2 of the intermediate contact portion 320 is larger than 0.9 times the width W1 of the upper contact portion 310, there is concern that air exhaust is not easy and thus vacuum formation is difficult.

As shown in FIG. 4, the packing 300 preferably has the entire height L1 of 10 to 20 min in consideration of easiness of combination between the receptacle lid and the receptacle body 10 through contraction and the depth of the packing installation groove 132. In addition, the thickness T1 of the upper contact portion 310 and the thickness T3 of the lower contact portion 330 are preferably 1 to 3 mm, and the thickness T2 of the intermediate contact portion 320 is preferably 0.5 to 2 mm in consideration of convenience of contraction in the longitudinal direction.

In addition, as shown in FIG. 5, in the packing 300, the height L2 at the maximum contraction due to the vacuum sealing is preferably 40 to 70% in the contraction ratio with respect to the entire height L1 before the contraction in consideration of easiness of sealing and elasticity necessary for pressing in order to secure an appropriate vacuum degree. For this, the Shore A hardness of the packing 300 is preferably 50 to 70, and this is because, if the Shore A hardness is smaller than 50, there is a problem in that the contraction ratio is too high, and thus the packing 300 is much deformed, resulting in reducing the contact force, and if the Shore A hardness is larger than 70, there is concern that the contraction is too low, and thus the contact force is reduced. In the present embodiment, the Shore A hardness of 55 is used as an optimal condition.

Hereinafter, with reference to FIGS. 4 to 6, an operation method of the vacuum receptacle lid for easy sealing according to the embodiment of the present invention will be described.

When the user covers the receptacle 1 with the lid such that the lower contact portion 330 of the packing 300 corresponds to the inlet portion 12 of the receptacle body 10 in a state of putting contents, for example, foods (not shown) in the receptacle body 10, and presses down the lid body 100 so as to vacuumize the inside of the receptacle 1, as shown in FIG. 6, air inside the packing installation groove 132 is exhausted to outside via the side surfaces of the intermediate contact portion 320 and the lower contact portion 330, and thus the inside of the vacuum receptacle 1 forms vacuum. Even if the user stops pressing down the lid body, since the upper contact portion 310 comes into complete contact with the upper surface 134, the lower contact portion 330 comes into complete contact with the inlet portion 12, and the air vent holes 124 come into complete contact with the body portion 210 of the packing 210, the inside of the vacuum receptacle 1 can continuously keep the vacuum state by a pressure difference between the inside and the outside of the vacuum receptacle 1, and liquid included in the contents such as foods cannot be leaked to the outside.

Hereinafter, a vacuum receptacle lid for easy sealing according to another embodiment of the present invention will be described with reference to FIG. 7 mainly based on differences from the vacuum receptacle lid according to an embodiment of the present invention.

Figure 7:
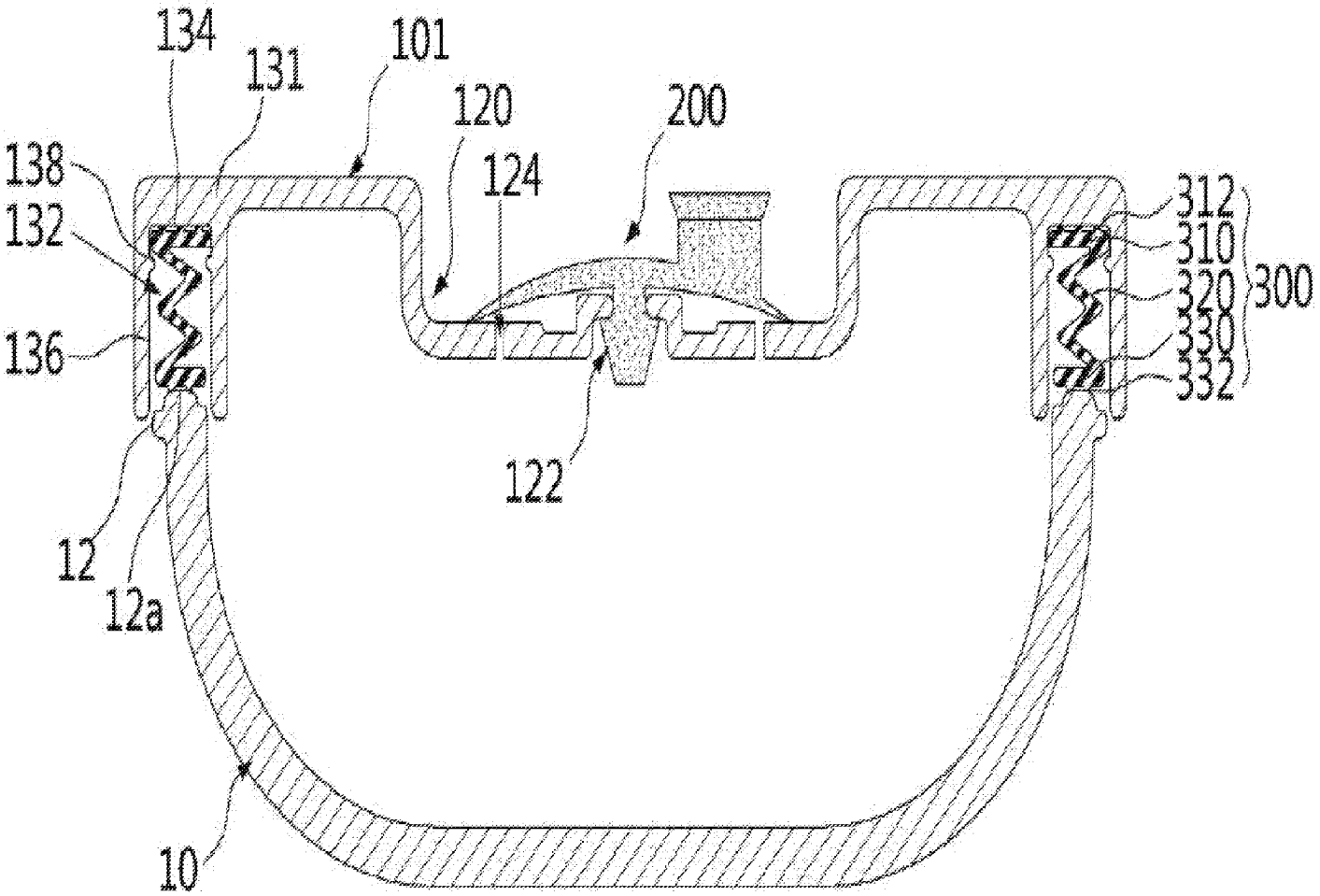
FIG. 7 is a cross-sectional view of a vacuum receptacle lid for easy sealing according to another embodiment of the present invention.
Figure 8:
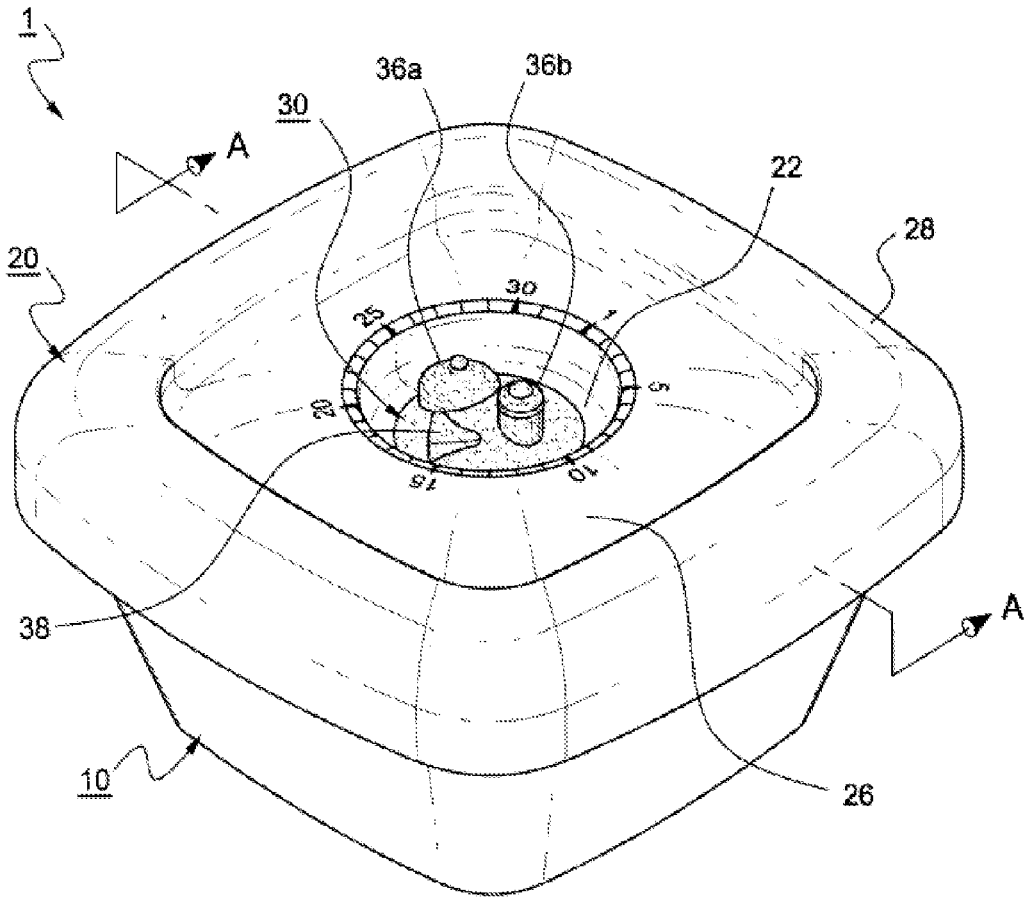
FIG. 8 and FIG. 9 are respectively an assembled perspective view and an exploded perspective view of a vacuum receptacle to which a vacuum receptacle lid for easy sealing according to the related art is applied.
Figure 9:
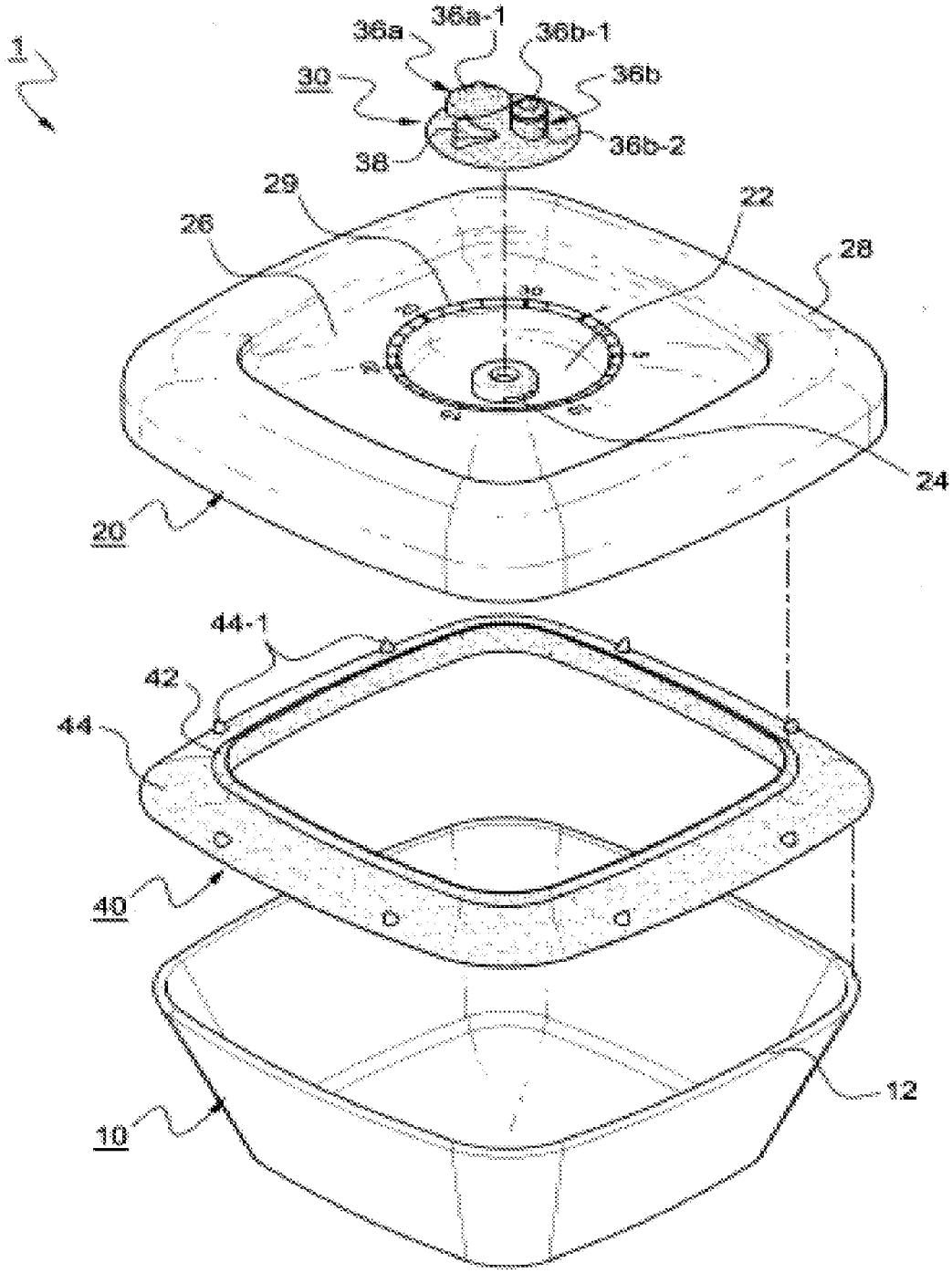
Figure 10:
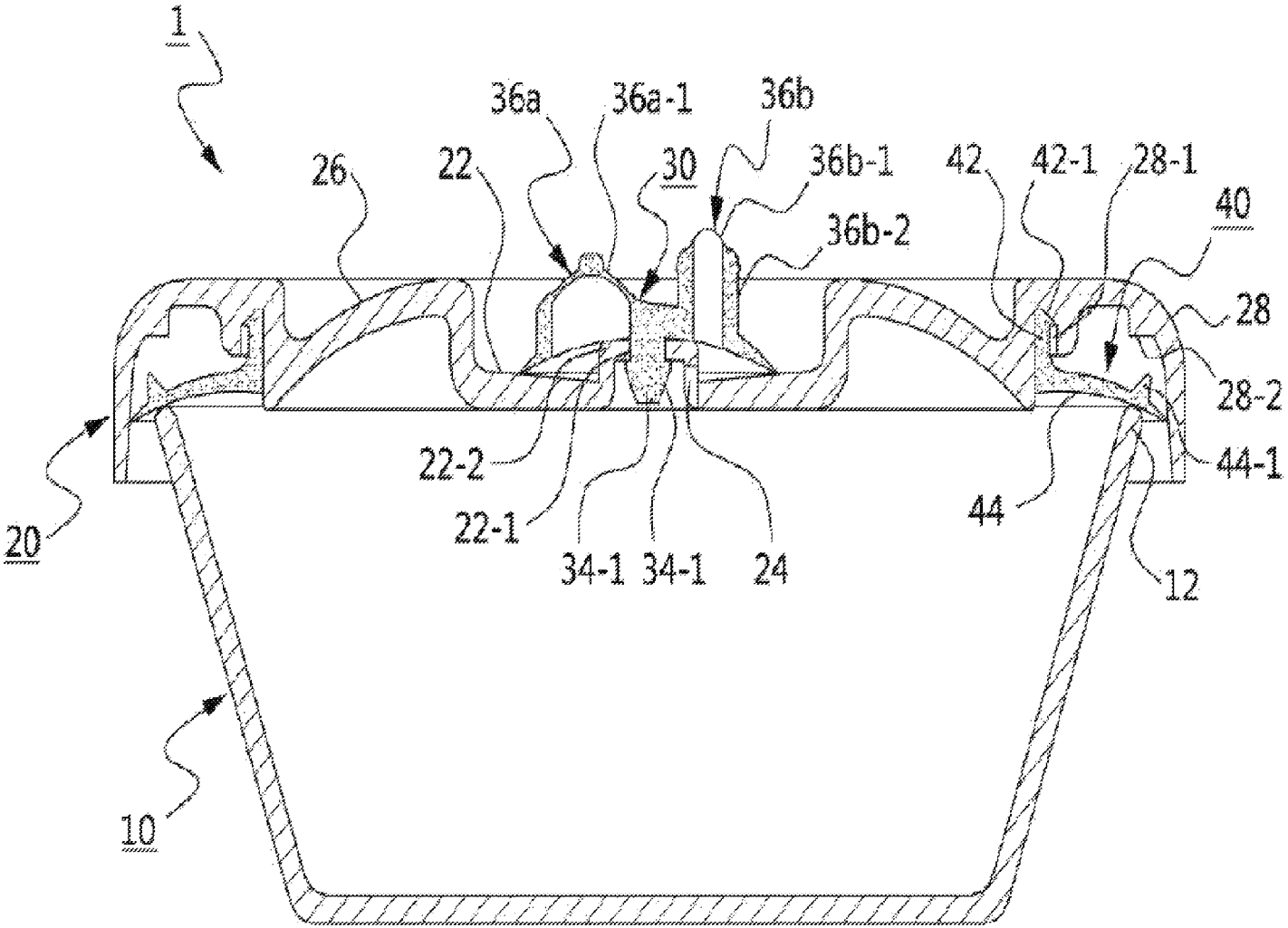
FIG. 10 is a cross-sectional view of the vacuum receptacle taken along the line A-A of FIG. 8.
Figure 11:
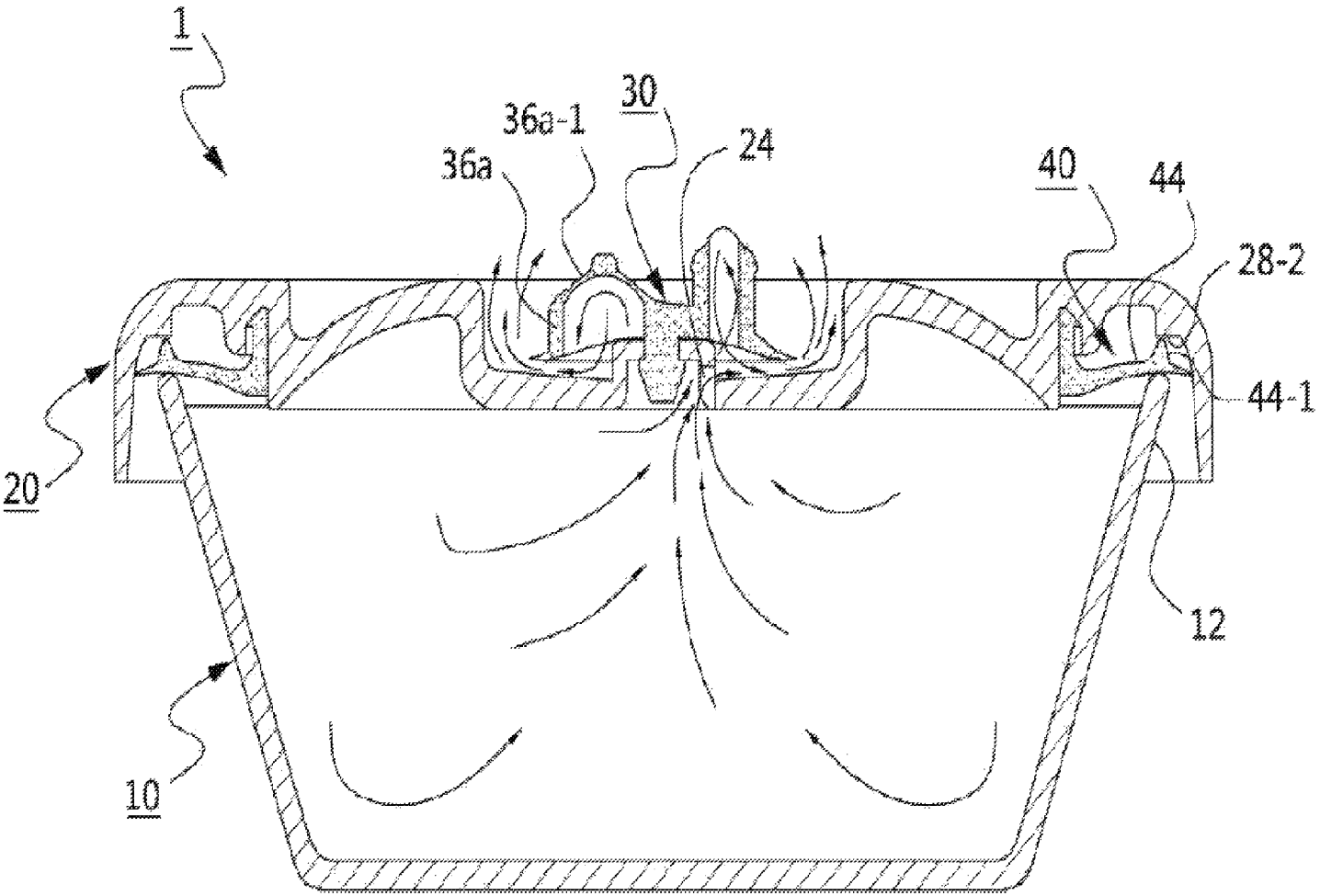
FIG. 11 and FIG. 12 are respectively cross-sectional views illustrating an operation during the vacuum-sealing of the vacuum receptacle to which the vacuum receptacle lid according to the related art is applied.
Figure 12:
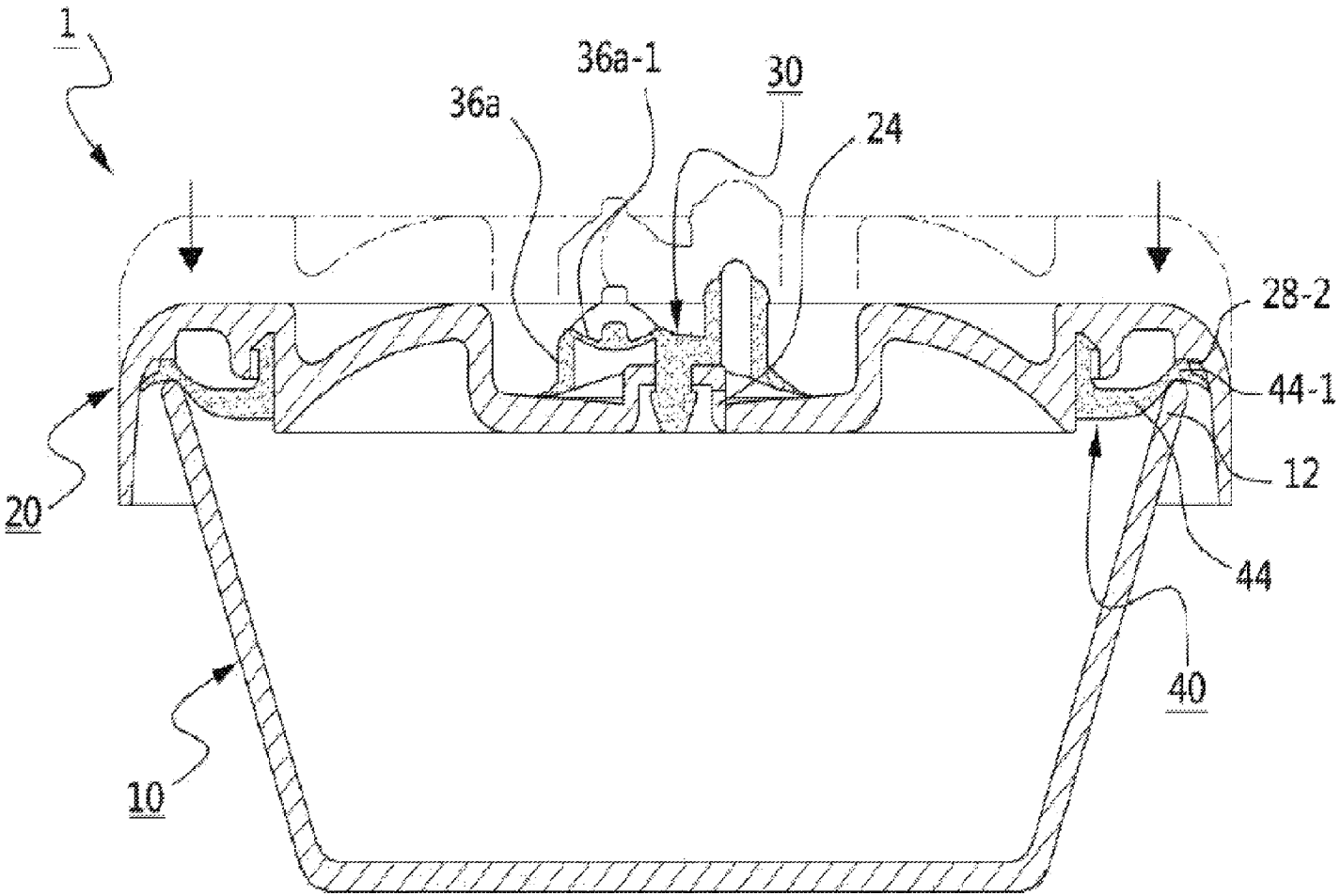

FIG. 7 is a cross-sectional view of the vacuum receptacle lid for easy sealing according to another embodiment of the present invention.

The vacuum receptacle lid for easy sealing according to another embodiment of the present invention is the same as the vacuum receptacle lid for easy sealing according to an embodiment of the present invention except that a protrusion 138 for accommodating the upper contact portion 310 so as to be combined therewith is further provided at the side surface 136 of the packing installation groove 133 provided at a rim 131 of a lid body 101.

Therefore, when the packing 300 enters the packing installation groove 132 and is completely inserted thereinto, the upper contact portion 310 comes into complete vacuum contact with the upper surface 134 of the packing installation groove 132 and is thus maintained in a strong combining state. Thereby, the packing 300 further enhances the sealing in a procedure of sealing the vacuum receptacle 1, and, in contrast, the packing 300 can be simply divided from the packing installation groove 132 by gradually dividing the packing 300 therefrom after the user pulls out the grip portion 230 of the check valve 200 with the hand so as to cancel the vacuum state. Thus, more uniform pressure is applied to the entire part of the packing 300 and thus the packing 300 is not divided in a normal operation where the receptacle body 10 is closed or opened by the lid, and, in a case where the packing is required to be divided such as cleaning being performed, the packing 300 can be easily divided from the packing installation groove 132 and then be cleaned.

Although the preferred embodiments of the present invention have been described, the scope of the present invention is not limited thereto, and various modifications and alternations using the fundamental concept of the present invention defined in the following claims are also included in the scope of the present invention.

INDUSTRIAL APPLICABILITY

The vacuum receptacle lid for easy sealing is an industrially useful invention where the vacuum receptacle is easily sealed by achieving high vacuum of the inside of the receptacle without a user using a separate vacuumizing device or taking great pains with a packing structure having excellent elastic recovery.

In addition, the vacuum receptacle lid for easy sealing is an industrially useful invention where, since the packing coming into contact with the inlet portion of the receptacle body has a sufficient thickness in order to block inflow of external air and sealing is stably performed inside the packing installation groove, an initial high vacuum state can be maintained for a long time, and contents such as foods can be prevented from spoiling or decaying and the contents can be kept fresh for a long time by blocking liquid such as juice of the foods from being leaked to outside via the packing installation groove or the air vent holes when the foods are stored and the receptacle is used.

The invention claimed is:

1. A vacuum receptacle lid for easy sealing comprising:

a lid body that closes and opens an inlet portion of a receptacle body provided with a space for containing contents, and includes a valve installation hole formed at a part thereof, at least one air vent hole, and a packing installation groove which is opened downwardly in a C shape inside a rim thereof;

a check valve inserted into and combined with the valve installation hole by the use of a combining projection, wherein the check valve encloses the air vent hole, exhausts air of the inside of the receptacle body via the air vent hole and blocks inflow of external air by enclosing, opening and closing the air vent hole; and a packing that is accommodated and installed at the packing installation groove, and includes an upper contact portion coming into contact with an upper surface of the packing installation groove, a lower contact portion coming into contact with the receptacle body, and an intermediate contact portion of which ends are connected to at least a part of the upper contact portion and the lower contact portion and which has a cross-section of a zigzag shape, wherein the lower contact portion and the intermediate contact portion are provided so as to have a width smaller than that of the upper contact portion, and wherein air inside the packing installation groove is exhausted outside via side surfaces of the intermediate contact portion and the lower contact portion when the inlet portion of the receptacle body comes into contact with the lower contact portion so as to vacuumize the inside of the receptacle.

2. The vacuum receptacle lid for easy sealing according to claim 1, wherein at least the upper contact projection is formed at the upper surface of the upper contact portion in a longitudinal direction.

3. The vacuum receptacle lid for easy sealing according to claim 1, wherein at least the lower contact projection is formed at the lower surface of the lower contact portion in a longitudinal direction.

4. The vacuum receptacle lid for easy sealing according to claim 1, wherein the packing comprises a fine surface roughness which is formed by a surface corrosion process through a micro discharge process.

5. The vacuum receptacle lid for easy sealing according to claim 1, wherein the packing has a Shore A hardness of 50 to 70.

6. The vacuum receptacle lid for easy sealing according to claim 1, wherein the packing installation groove is further provided with a protrusion accommodating the upper contact portion so as to be combined therewith at a side surface.

7. The vacuum receptacle lid for easy sealing according to claim 1, wherein the packing has an entire height of 10 to 20 mm, wherein the thickness of each of the upper contact portion and the lower contact portion is 1 to 3 mm, wherein the thickness of the intermediate contact portion is 0.5 to 2 mm, and wherein the maximum contraction ratio to the height is 40 to 70%.

8. The vacuum receptacle lid for easy sealing according to claim 1, wherein the air vent hole is formed at an edge of the valve mounting groove and is enclosed by and comes into contact with an edge of the body portion.

* * * * *